US006595865B2

(12) United States Patent
Stitz

(10) Patent No.: US 6,595,865 B2
(45) Date of Patent: Jul. 22, 2003

(54) PUTTING PRACTICE APPARATUS FOR DEVELOPING A PENDULUM PUTTING STROKE

(76) Inventor: Steven M. Stitz, 13394 Cove Landing Rd., Bishopville, MD (US) 21813

( * ) Notice: Subject to any disclaimer, the term of this patent is extended or adjusted under 35 U.S.C. 154(b) by 0 days.

(21) Appl. No.: 09/848,273

(22) Filed: May 4, 2001

(65) Prior Publication Data

US 2002/0165037 A1 Nov. 7, 2002

(51) Int. Cl.[7] ..... A63B 53/06; A63B 53/16; A63B 69/36

(52) U.S. Cl. ..... 473/257; 473/266; 473/441

(58) Field of Search ..... 473/257, 266, 473/271, 215, 216, 207, 208, 209, 210, 211, 258, 259, 260, 274, 275, 277, 441, 442, 443, 444, 445

(56) References Cited

U.S. PATENT DOCUMENTS 2,737,432 A * 3/1956 Jenks
3,429,571 A * 2/1969 Abel, Jr.
3,827,690 A * 8/1974 Rogers
3,927,879 A * 12/1975 Long et al.
4,140,315 A * 2/1979 Page, Jr.
4,659,084 A * 4/1987 Vuick
4,758,000 A * 7/1988 Cox
5,039,105 A * 8/1991 Ro
5,577,729 A * 11/1996 Sabour
5,800,291 A * 9/1998 Grover
6,196,933 B1 * 3/2001 Hope et al.

* cited by examiner

*Primary Examiner*—Paul T. Sewell
*Assistant Examiner*—Nini F. Legesse
(74) *Attorney, Agent, or Firm*—Welsh & Flaxman LLC

(57) ABSTRACT

A golf putting training apparatus for a golfer to develop a pendulum stroke including a rigid, upright support and a shoulder engaging guide rotatably attached to the support. The shoulder guide is connected to a rotatable bearing positioned perpendicular to the ground, whereby the golfer's shoulders may only move in a vertical plane, ensuring that a pendulum stroke is achieved.

14 Claims, 4 Drawing Sheets

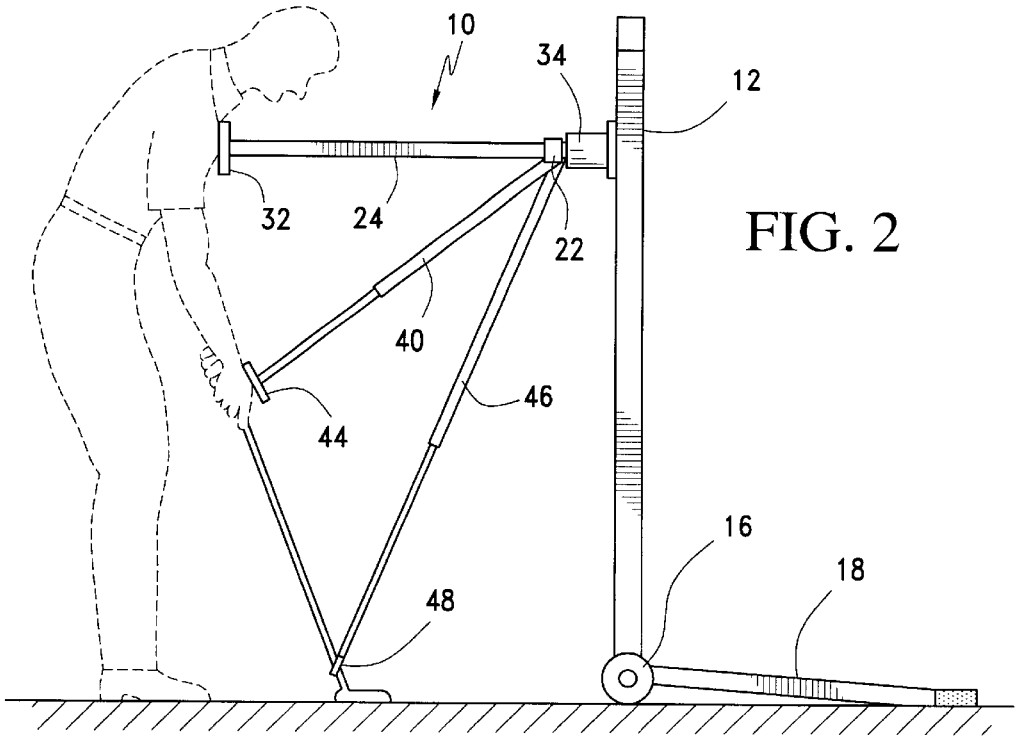
FIG. 2
FIG. 3
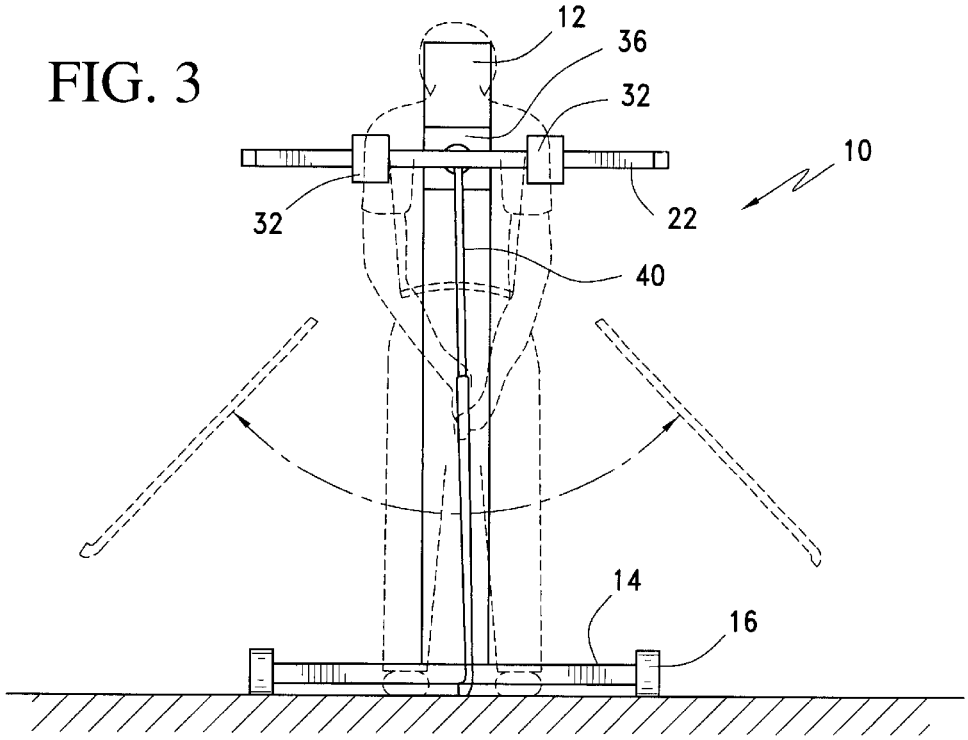

PUTTING PRACTICE APPARATUS FOR DEVELOPING A PENDULUM PUTTING STROKE

BACKGROUND OF THE INVENTION

The present invention relates to a putting practice device and, in particular, a device for training a golfer to develop a pendulum putting stroke.

A key to proficient putting in playing the game of golf, lies in developing a consistent putting stroke. The direction that a ball takes when rolling on a green toward a hole depends upon three major variables. The first critical factor in executing a proper putting stroke is the club head path. A second factor is the position of the club face relative to the ball, that is, whether the club face is open or closed. A third factor is the location on the putter striking face where the ball is actually struck, it being appreciated that hitting a ball precisely at the center of percussion will produce the truest and straightest roll. It has long been thought that the putting stroke was a miniature of a full golf swing; that is, the club head moves in an arcuate path by being brought back on an inside path during the back swing, returned to a square position at impact, and returned on an inside path during the follow through. This motion opens the club face during the back swing portion of the stroke and closes it during the follow through portion of the stroke relative to the line a golf ball must roll in order to be holed. By opening and closing the putter club face, consistency in the execution of a golf stroke becomes much more difficult.

A more scientific approach to developing a pure putting stroke concludes that the stroke should emulate a pure pendulum movement, whereby the putter face remains square and follows a straight line path with a straight back, straight through motion coincident with the aim line a golfer has selected after reading the green surface in order to hole the golf ball. This straight path motion minimizes deviations in the path of the putter head, which commonly occur with an arcuate stroke, and also aids in maintaining the club face perfectly square throughout the full extent of the putting stroke including the back swing, and the impact position and the follow through.

In order to execute a pendulum putting stroke, a golfer's shoulders must hang vertically. Preferably the shoulders are located directly over the golf ball, although that is not necessary. Moving the shoulders only in a vertical plane, while maintaining the hands in a rigid, fixed position on the golf club grip, will result in a pure pendulum stroke.

Various putting practice devices have been developed for golfers to develop a pendulum putting stroke. Among these devices are those disclosed in U.S. Pat. Nos. 4,251,077, 4,130,282 and 4,437,669, to David Pelz, a well known short game teacher who is a strong proponent of the pendulum putting method. U.S. Pat. No. 4,437,669 relates to a golf practice putting track which is contoured to follow a putter head during a putting stroke. The track includes a pair of rails which may be adjusted with respect to each other so that precise tolerances are maintained between the putter head and rails, thereby insuring that the putter maintains a straight back, straight through path in order to avoid hitting the rails of the track. U.S. Pat. No. 4,251,077 relates to an electronic target alignment system using a mirror and reflected light to ensure that the angle of the putter face remains square during the execution of a stroke. U.S. Pat. No. 4,130,282 relates to a putting system using a practice insert which insures a ball is hit precisely on the center of percussion.

Other patents of interest for maintaining a golfer's shoulders in a predetermined position include U.S. Pat. No. 3,397,892 to Stahl, which uses a pair of shoulder braces connected to an upright post by means of a tubular adjustment sleeve having a fixed boss which extends outwardly and downwardly at an angle calculated to be proper relative to the horizontal for positioning the golfer's head and neck during the execution of the swing. The device includes a rotary joint connecting the shoulder apparatus to the fixed post.

U.S. Pat. No. 5,586,761 to Brock et al. and U.S. Pat. No. 5,039,105 to Roboth show golf training apparatuses wherein shoulder guides are positioned on the shoulders of a golfer during the execution of a swing.

SUMMARY OF THE INVENTION

The present invention relates to an apparatus for teaching a golfer to make a pure pendulum stroke by maintaining the golfer's shoulders in a vertical plane during the execution of a putting stroke. The device includes a pair of shoulder engaging members which are rotatably connected to a fixed, upright support. The upright support may be directly attached to a wall or other fixed surface, or it may be mounted on a tripod or similar upright stand. The stand may be mounted on a cart or trolley apparatus with wheels to facilitate transportation of the unit. In a preferred embodiment, the shoulder engaging members extend perpendicular from or horizontal to a fixed vertical support surface and are adjustably movable upward or downward to accommodate golfers of different heights. The mounting post and shoulder engaging members are rotatably connected relative to each other by means of a bearing disposed in a vertical plane, parallel with the post. In this position the bearing is moveable only in a vertical direction. When a golfer executes a putting stroke, the arms and hands holding a putter follow the movement of the shoulders as they vertically rotate, thereby ensuring that the putter movement is also vertical to the ground surface. Assuming a golfer maintains his hands in a fixed position on the club head, the club head ball striking face can only move in a direction limited by the pendulum motion of the apparatus, thus creating a pure pendulum golf stroke.

Among the objects of the present invention is the provision of a golf putting practice apparatus to enable a golfer to develop a pure pendulum putting stroke.

Another object of the present invention is the provision of a putting practice apparatus which may be used either indoors or outdoors to develop a putting stroke.

Still another object of the present invention is the provision of a putting training apparatus which can be used by all sized golfers to develop a pendulum putting stroke.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 2 is a side elevational view including a dotted line showing of a golfer using the device.

FIG. 3 is a front elevational view including a dotted line showing of a golfer using the device.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
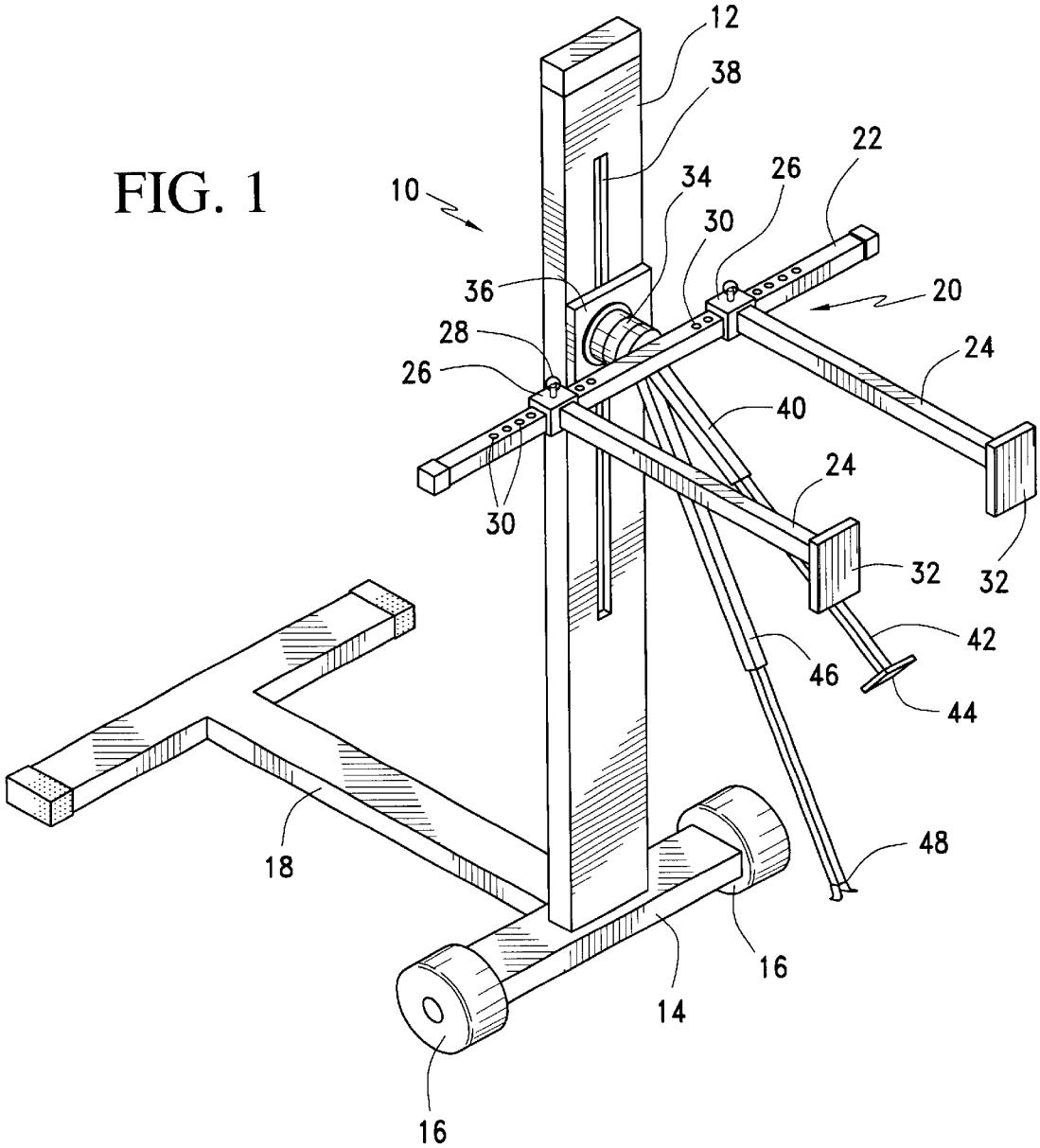
FIG. 1 is a perspective view of the putting practice device of the present invention.

Referring to the drawings, FIG. 1 shows a putting training apparatus 10 in accordance with the present invention. The apparatus 10 is preferably made of metal or heavy gage plastic. The apparatus 10 includes an upright support column 12 mounted on a base member 14 having wheels 16 on opposite ends of the base member 14. An integrally formed T-shaped support 18 extends outwardly from the base member 14, enabling the unit 10 to be wheeled to a preselected position and non-movably located there using the support 18. A U-shaped shoulder engaging guide 20 is formed of a horizontal bar 22 extending in a plane parallel to the upright support column 12. A pair of shoulder engaging arms 24 are perpendicular to and are attached to the horizontal bar 22 by slidable bushings 26 which conform to the shape of and are slidable along the horizontal bar 22. Each bushing 26 includes a spring mounted pin 28 which cooperates with a series of openings 30 in the horizontal bar 22 whereby the bushings 26 may be located independent of each other along the length of the bar 22. This permits the spacing between each of the shoulder engaging arms 24 to be adjusted to accommodate a particular golfer. The distal ends of the shoulder engaging arms 24 are provided with shoulder engaging pads 32. The U-shaped guide 20 is attached to the support column 12 by means of a rotatable bearing 34 which is mounted perpendicular to the plane of the support column 12, or in other words, the bearing 34 rotates in a plane parallel to the vertical support column 12. With the vertical support column 12 positioned perpendicular to the ground, the bearing 34 is able to only rotate in a vertical plane. The bearing 34 is mounted on a plate 36 which is slidably movable in a vertical direction in an elongated vertical slot 38 in the support column 12. This enables the guide 20 to be raised or lowered in accordance with the height of a particular golfer. A first telescoping rod 40 is attached to the horizontal bar 22. A distal end 42 of the rod 40 is formed with a hand engaging pad 44. A second telescoping rod 46 is also connected to the horizontal bar 22. The distal end of rod 46 is formed with a putter engaging clip 48.

Figure 5:
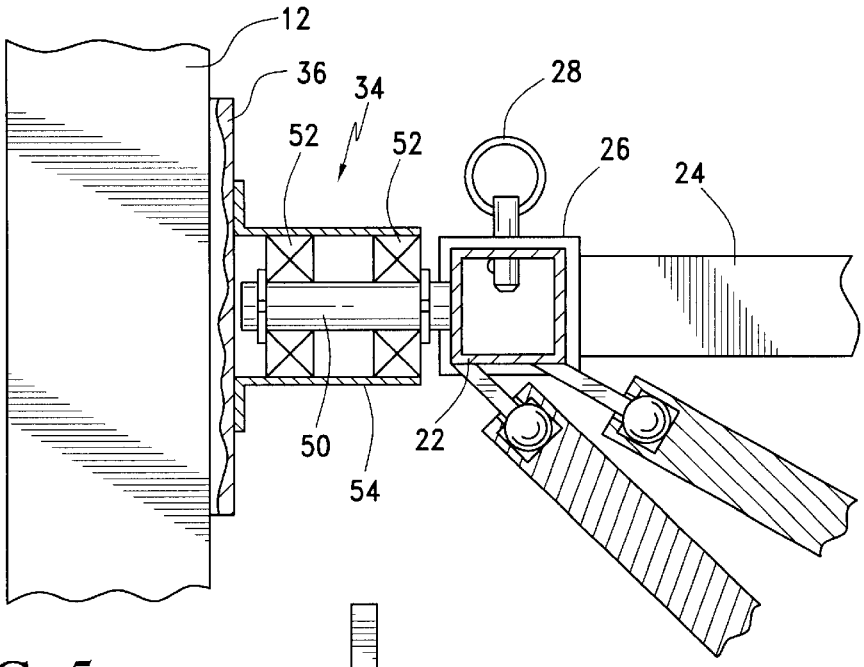
FIG. 5 is a view of a detail, partially in section, of the present invention.
Figure 4:
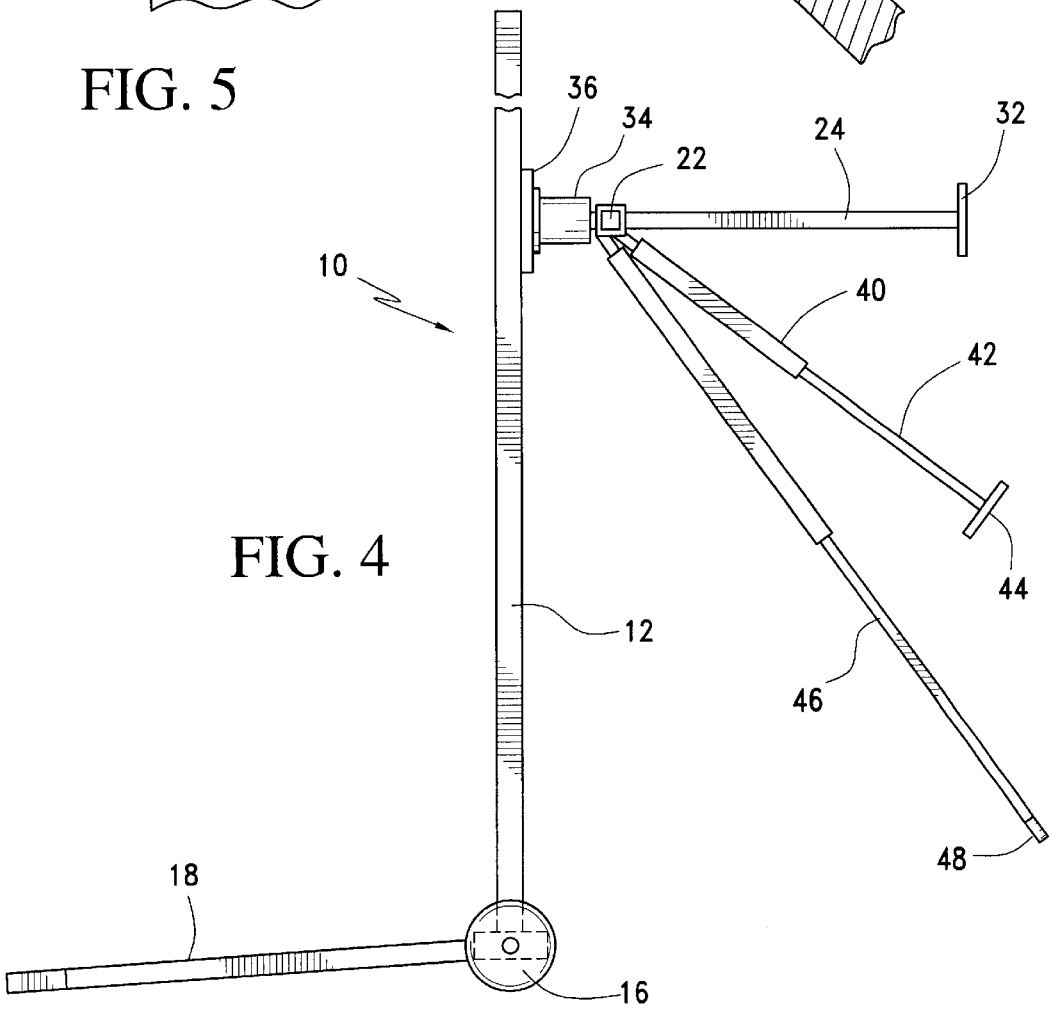
FIG. 4 is a side elevational view of the invention in a nonuse position.

FIG. 5 shows a detail of the connection of the bearing 34 to the support column 12 and to the horizontal bar 22. The bearing 34 is formed with a rotatable, cylindrical shaped inner bearing member 50 which is rigidly attached to the horizontal bar 22 and rotatably moveable therewith. The inner member 50 is supported in fixed bearing sleeves 52 rigidly connected to a bearing housing 54 which, in turn, is rigidly attached to the plate 36. The bearing connection permits rotation of the bearing 34 in a direction perpendicular to the support column 12 therefore limiting movement of the horizontal bar 22 in a plane parallel to the support column 12 or in use, in a vertical plane with the apparatus 10 properly set up for use by a golfer in a practice mode.

Referring to FIGS. 2, and 3, it can be seen that a golfer addresses a golf ball with the shoulder engaging pads 32 snugly positioned against the golfer's shoulder. The telescoping rod 40 is positioned against the golfer's hands using the pad 44. The telescoping rod 46 is clipped to a lower part of the golfer's putter. When a golfer executes a putting stroke with the shoulder engaging pads 32 in contact with the shoulders, the U-shaped guide 20 is rotated in a vertical direction perpendicular to the ground. This structure permits a golfer to train himself to maintain the shoulder pads 32 on his shoulders, which in turn, ensures that the shoulders rotate in a plane parallel to the bearing which, of course, is perpendicular to the ground, resulting in a pendulum-like putting stroke. It will be appreciated that, if the shoulder pads 32 slip from the shoulders during the execution of a stoke, the arms and shoulders of the golfer will not necessarily stay in a parallel or pendulum stroke position. The rods 40 and 46 maintain the golfer's hands and the putter in a fixed position so that it is difficult for the hands to break down during the putting stroke, thus keeping the putter head in a straight back, straight through position, with the putter striking face in a square position relative to a selected target aim line.

It will be appreciated that by repeated use of the practice apparatus 10 of the present invention, a golfer will train his arms and shoulders to stay connected with the shoulder guide 20 to develop the desired pendulum putting stroke.

Figure 6:
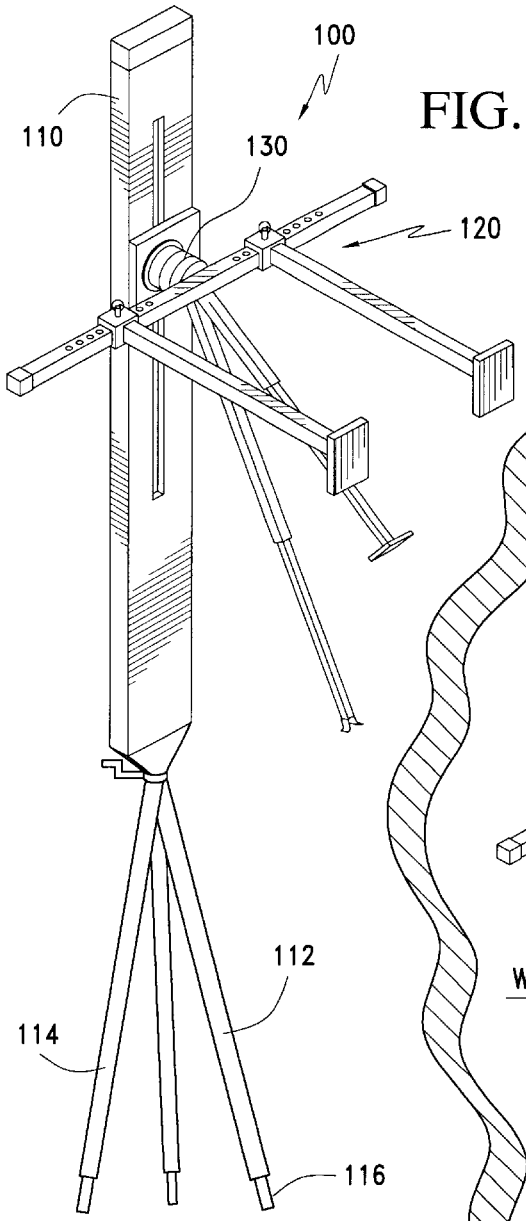
FIG. 6 is a perspective view of an alternate embodiment of the putting practice apparatus of the present invention.

FIG. 6 shows a further embodiment of a putting training apparatus 100 including a support column 110 which is mounted on a tripod 112 formed of three legs 114. Preferably, the tripod 112 is a heavy industrial type which is adjustable and may include suitable ground engaging feet 116 enables the apparatus to be used indoors or outdoors. It will be appreciated that a shoulder guide 120 and bearing structure 130 is attached to the support column 110. Features other than the tripod mounting are identical to and operate in the same manner as the embodiment described hereinabove.

Figure 7:
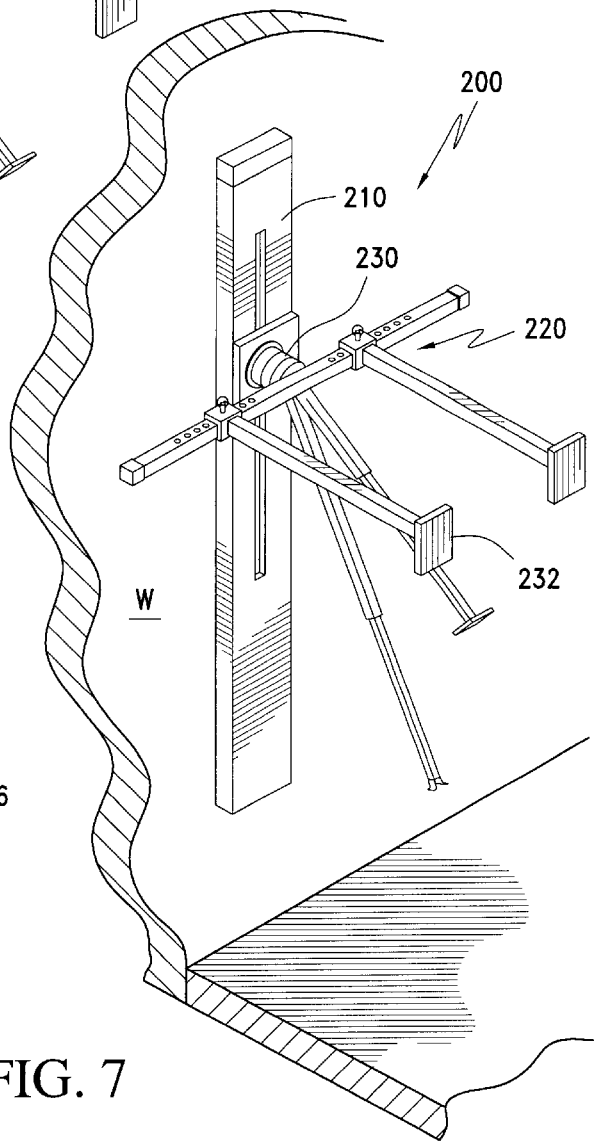
FIG. 7 is a perspective view of another alternate embodiment the putting practice apparatus of the present invention.

FIG. 7 shows a still further embodiment of a putting training apparatus 200 which is directly mounted to a wall W using a mounting column 210 which may be screwed or otherwise attached to the wall W support surface. A U-shaped shoulder guide 220 having shoulder engaging pads 232 is attached to the mounting column 210 by means of a bearing 230. Features other than the wall mounting are identical to and operate in the same manner as the embodiment described hereinabove. This embodiment permits permanent attachment of the apparatus 200 for indoor use in a home exercise environment. The permanently attached apparatus 200 is adjustable to accommodate golfers of a various sizes and heights in order to serve as a personalized exercise apparatus.

It will be appreciated that modifications may be made to the invention while keeping within the spirit and scope of the invention as defined in the following claims.

What is claimed is:

1. A golf training apparatus for enabling a golfer to develop a pendulum putting stroke comprising:

a rigid support disposed perpendicular to a horizontal support surface;

a shoulder guide extending perpendicular from said rigid support attached to said shoulder guide for engaging the shoulders of a golfer; and a rotatable bearing for connecting said rigid support and said shoulder guide such that the shoulder guide is free to rotate about a rotational axis perpendicular to said rigid support;

wherein rotation of said shoulder guide is restricted to rotation in a vertical direction parallel to said rigid support and perpendicular to said support surface, whereby a golfer executing a putting stroke engages the shoulder guide such that the shoulder guide is rotated in a vertical direction perpendicular to the support surface while performing a putting stroke thus training a golfer to rotate the shoulders in a plane perpendicular to the support surface with a pendulum-like putting stroke.

2. The apparatus of claim 1, wherein said rigid support includes an upstanding support column.

3. The apparatus of claim 2, further including a ground contacting means connected to a lower end of said rigid support;

said ground contacting means includes a wheeled support member combined with a stabilizing support extending outwardly therefrom.

4. The apparatus of claim 1, wherein said support is a tripod and an upstanding support rod extending therefrom and further includes rotational bearing means connecting said rod and said shoulder guide.

5. The apparatus of claim 1, wherein said support is structured to be wall mounted to a vertical support surface.

6. The apparatus of claim 1, wherein said support is a tripod and an upstanding support rod extending therefrom and further includes rotational bearing means connecting said rod and said shoulder guide and wherein said bearing means includes a first member attached to said rigid support and a second rotational member attached to said shoulder guide.

7. The apparatus of claim 1, further including a first rod member attached to said shoulder guide having a hand engaging member on a distal end thereof.

8. The apparatus of claim 7 wherein said rod is formed in two mutually telescoping sections.

9. The apparatus of claim 1, further including a second rod member attached to said shoulder guide having a putter engaging member on a distal end thereof.

10. The apparatus of claim 9 wherein said rod is formed in two mutually telescoping sections.

11. The apparatus of claim 1 further including adjusting means for adjusting the location of said shoulder guide on said support column.

12. The apparatus of claim 1 wherein said shoulder guide includes a pair of shoulder engaging arms extending perpendicular to and outwardly from said support column.

13. The apparatus of claim 12 further including shoulder engaging pads at a distal end of each of said shoulder engaging arms.

14. The apparatus of claim 12 further including adjusting means for adjusting the width of said shoulder engaging arms.

* * * * *